US006786857B2

(12) United States Patent
Harsch et al.

(10) Patent No.: US 6,786,857 B2
(45) Date of Patent: Sep. 7, 2004

(54) TOOL-EXCHANGING DEVICE FOR PRESSES

(75) Inventors: Erich Harsch, Weingarten (DE); Rainer Reichenbach, Schlier 2 (DE)

(73) Assignee: Mueller Weingarten AG, Weingarten (DE)

( * ) Notice: Subject to any disclaimer, the term of this patent is extended or adjusted under 35 U.S.C. 154(b) by 2 days.

(21) Appl. No.: 10/404,277

(22) Filed: Apr. 1, 2003

(65) Prior Publication Data

US 2004/0018925 A1 Jan. 29, 2004

(30) Foreign Application Priority Data

May 29, 2002 (DE) ..... 102 23 897

(51) Int. Cl.[7] ..... B23Q 3/155; B23D 43/05
(52) U.S. Cl. ..... 483/28; 483/29; 72/405.1
(58) Field of Search ..... 483/28, 29; 72/405.1, 72/405.2, 405.13, 405.16, 405.11, 405.12

(56) References Cited

U.S. PATENT DOCUMENTS 4,587,716 A * 5/1986 Bytow ..... 483/29
4,648,786 A * 3/1987 Sakurai ..... 72/405.1
4,932,235 A * 6/1990 Rieger et al. ..... 72/405.13
4,981,031 A * 1/1991 Schneider et al. ..... 72/405.05
5,248,288 A * 9/1993 Kamiya et al. ..... 483/28
5,582,061 A * 12/1996 Harsch et al. ..... 72/405.1
5,584,205 A * 12/1996 Harsch et al. ..... 72/405.02
5,979,212 A * 11/1999 VanderZee et al. ..... 72/405.09
6,126,582 A * 10/2000 Dangelmayr et al. ..... 483/28

FOREIGN PATENT DOCUMENTS

| | | |
|---|---|---|
| DE | 43 09 661 | 12/1994 |
| DE | 100 09 574 | 8/2001 |
| GB | 2 199 781 | 7/1988 |

* cited by examiner

*Primary Examiner*—A. L. Wellington
*Assistant Examiner*—Dana Ross
(74) *Attorney, Agent, or Firm*—Jordan and Hamburg LLP

(57) ABSTRACT

An exchanging device is proposed for the parts-specific accessories and especially for the suction crossarm in a press, press line, multiple-die press for large parts or the like in order to make possible a good accessability of the press area, the exchanging device in the parked position is below the passable covering.

12 Claims, 7 Drawing Sheets

TOOL-EXCHANGING DEVICE FOR PRESSES

Figure 1:
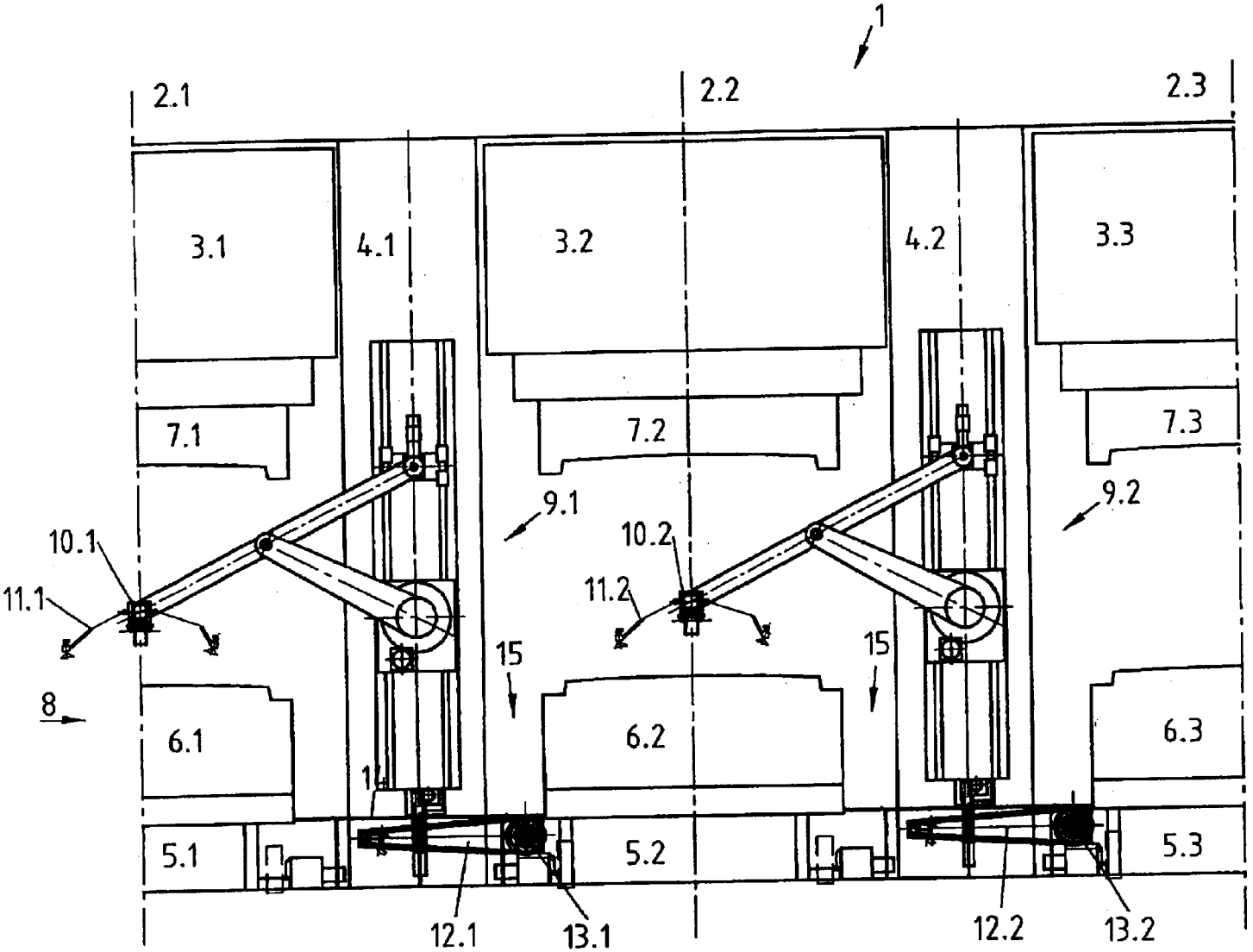

The invention relates to a tool-exchanging device and, in particular, to the suction crossbar-exchanging device in press lines, multiple-die presses for large parts or he like.

STATE OF THE ART

In the case of a press, a press line or a multiple-die press for large parts, transfer devices are provided for transporting parts. For the newer developments of the German patent 100 09 574, the transporting process proceeds through separate transporting systems assigned to each press or press stage. These devices, which can be controlled or regulated individually, carry away the workpiece, which is to be shaped, from one tool step and supply it to the subsequent tool stage. The transporting system is constructed as a sort of pivoted arm. By integrating a large number of degrees of freedom or movement axes, it is possible, during the transporting movement, to carry out a change in the position of the workpiece, which is optimally adapted to the shaping process. This also makes it possible to do without interim storage areas and, with that, to reduce significantly the distances between tool stages. The total length of the press installation is reduced clearly by this measure.

Likewise, a completely automatic tool-exchanging system, including an exchanging system for the parts-specific accessories of the transporting system, is known as state of the art. An appropriate representation is given in the German patent 43 09 661. When tools are exchanged, the transverse lifting beams or suction crossarms, carrying the workpieces are pegged out on connecting pins. These connecting pins are fastened to the sliding table. With that, the transverse lifting beams can be moved out of the press room. During the production phase, the connecting pins are swiveled laterally above the upper edge of the sliding table into an approximately horizontal position. In order to avoid a collision with the transporting system, it is necessary to carry out this swiveling of the connecting pins outside of the area in which the workpiece is transported The inadequate accessibility of the press is a disadvantage of this and other known systems. Due to the space-saving construction resulting from the newer transfer systems, there is very little access to the free spaces between the sliding table with tool and the press pedestal. When there are operational malfunctions during production, access to the press area must be possible. Due to the swiveled connecting pins, disposed at a greater height, this access is impeded greatly. The solution, disclosed in the British patent 2,199,781, with cantilevers mounted laterally in the outer regions of the sliding table and with a pivotable removing device for suction crossarms, is likewise advantageous.

OBJECT OF THE INVENTION

It is an object of the invention to avoid the above-described disadvantages of the state of the art and to configure a tool-exchanging device and, in particular, an exchanging device for the parts-specific accessories in such a manner, that accessibility to the press area is not impeded thereby. The exchanging device shall be relatively inexpensive and constructed in the form of a modular system in a space-saving manner.

Starting out from a transporting system and a tool-exchanging device of the type described above, this objective is accomplished pursuant to the invention by the distinguishing features.

ADVANTAGE OF THE INVENTION

Due to the inventive solution, the objective posed can be accomplished and the disadvantages of the state of the art avoided by the application of the individual distinguishing features as well as by their inventive combination. Moreover, the invention is based on the concept of disposing the exchanging device for the parts-specific accessories and configuring the course of motion in such a manner, that any impediment to the accessibility of the press area is avoided.

In a compact construction, the exchanging device usually consists of two units, which are mounted one each at the end regions of the sliding table. Two types of movement are proposed for moving the device into the exchanging position:

1. A swiveling motion totaling approximately 90°
2. A vertical, linear motion

The pivot drive makes different positions of the exchanging device possible. These may, for example, be the following:

horizontal position during the production phase position inclined at the required angle for the transfer of the suction crossarm to the press and also for exchanging the suction crossarm outside of the press. This position is also advantageous for exchanging tools.

perpendicular position as exit or entry position or also, in an alternative variation, for transferring the suction crossarm in the press.

For one embodiment, a driven-in parked position and a driven-out exchanging position are provided by means of a linear driving mechanism.

The exchanging device is equipped with a mounting and optionally with a clamping system for the suction crossarm. In order to avoid interfering edges due to the suction spiders fastened on the suction crossarm, the latter may have to be able to rotate about its axis. This rotating device may be a component either of the exchanging device or of the transporting system.

During the exchange of tools, the transporting system with the suction crossarm in the pedestal region is in a parked position. By a downward movement of the ram, the upper tool is moved onto the lower tool and the jig is loosened. After that, the ram moves up and the tool-exchanging device moves into the exchanging position in order to take over the suction crossarm. Two variations, for example, are possible during the swiveling:

1. The tool-exchanging device is swiveled so far, that the suction crossarm can be transferred into the parked position of the transporting system. At the same time, the mounting and clamping system of the exchanging device of the suction crossarm is taken over in a precise position and then uncoupled from the transporting system. The uncoupling is also required for the energy-supplying pipelines and the vacuum system. After the takeover, the tool-exchanging device swivels into a vertical position and, at the same time, rotates the suction crossarm in such a manner about its axis, that the suction spiders assume a position required for the trouble-free moving out.
2. In the case of the alternative variation, the tool-exchanging device swivels by about 90° from the horizontal position into the vertical position. The transporting system swivels from the parked position so far in the direction of the tool-exchanging device, that a transfer of the suction crossarm is possible. In addition, the transporting system rotates the suction crossarm by an amount, which, in turn, also makes the problem-free moving out of the suction spiders possible. In the case of this solution, the suction crossarm clamping system in the tool-exchanging device may optionally be omitted.

If the exchanging device is driven by means of a linear drive, the course of the movement of the transporting system is as described under 2. In order to reduce the necessary moving-out path of the exchanging device, the transporting system additionally moves into a lower position, which is slightly larger than half the width of the suction spider. Depending on the construction and position of the mounting, the suction crossarm can be transferred to the exchanging device by a vertical as well as by a horizontal movement.

The invention is particularly advantageous if the tool-exchanging device represents a form of modular system. By the proposed solutions, an advantageously priced and very compact construction is achieved.

The driving mechanism for the swiveling motion as well as the linear drive are attached in a stationary manner at the sliding table. This is advantageous for reducing the weights, which have to be accelerated, as well as for connecting the electrical leads.

Changing the setup outside of the press is also facilitated by the invention. The clamping sites of the lower tool are accessible without any obstruction. An optimum exchanging position can be achieved by swiveling the exchanging device with the suction crossarm through any angle. Likewise, there are no interfering regions for the attachment and function of the transporting ropes, which are required for lifting or placing down the tools by means of a crane.

Figure 2:
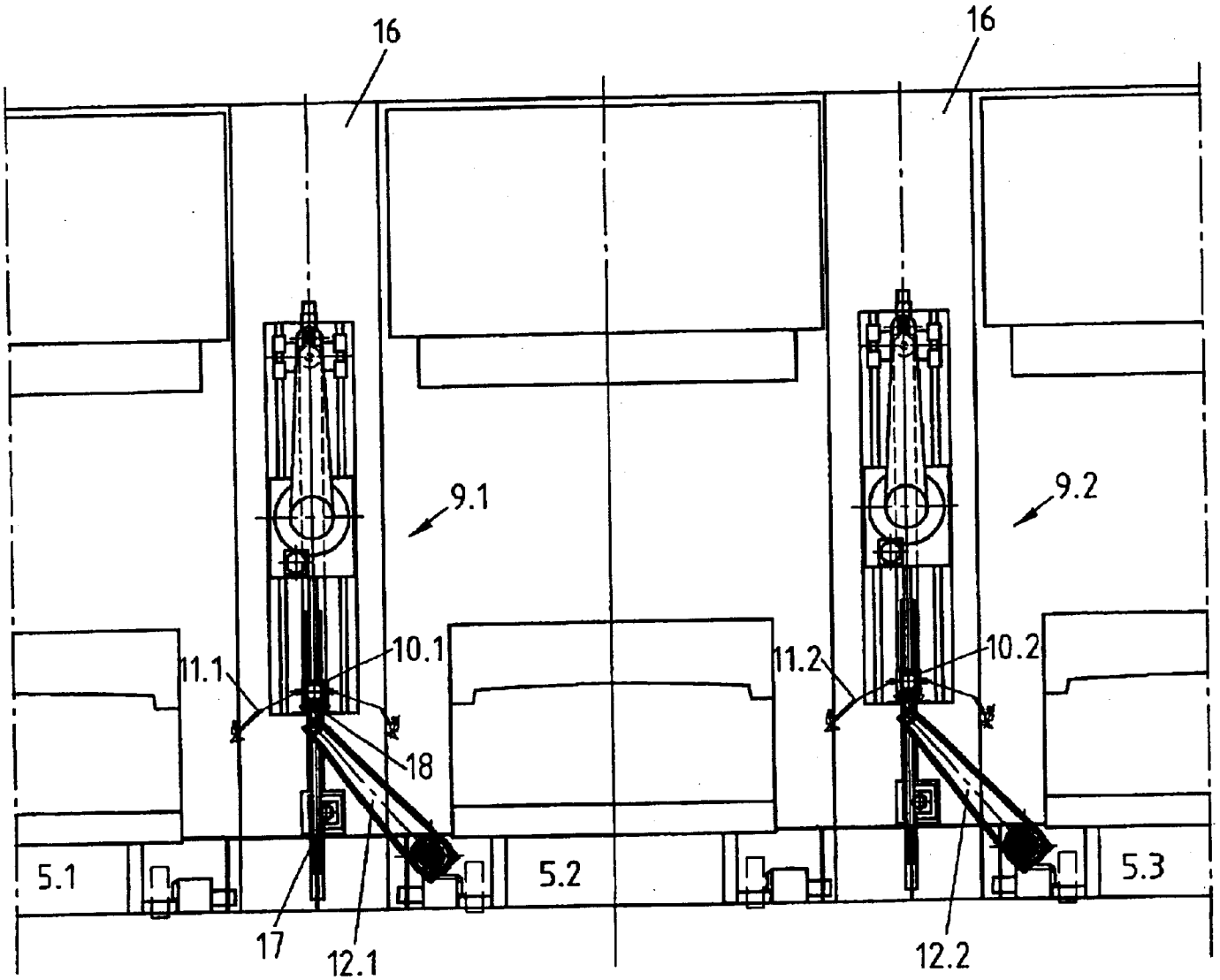
Figure 3:
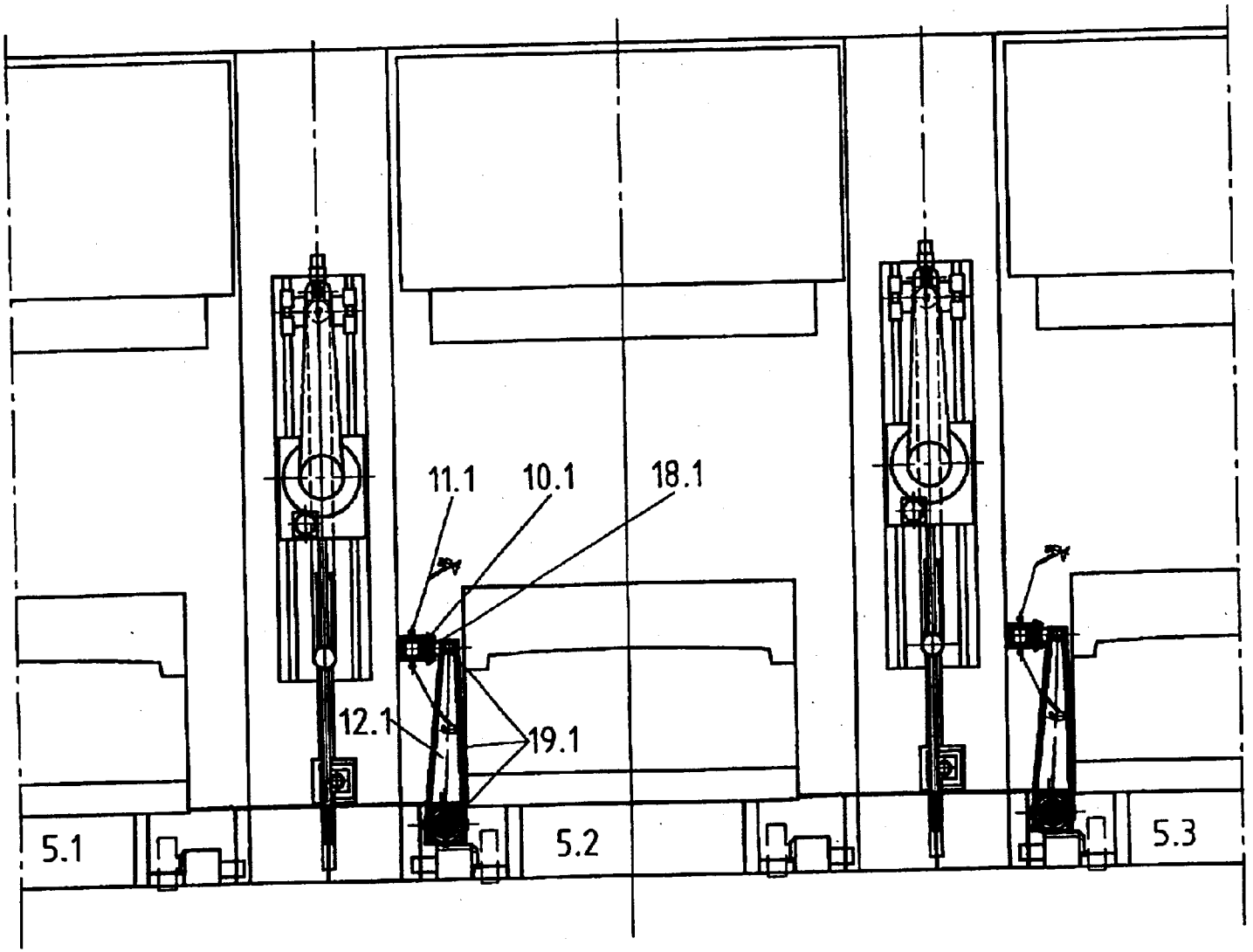
Figure 4:
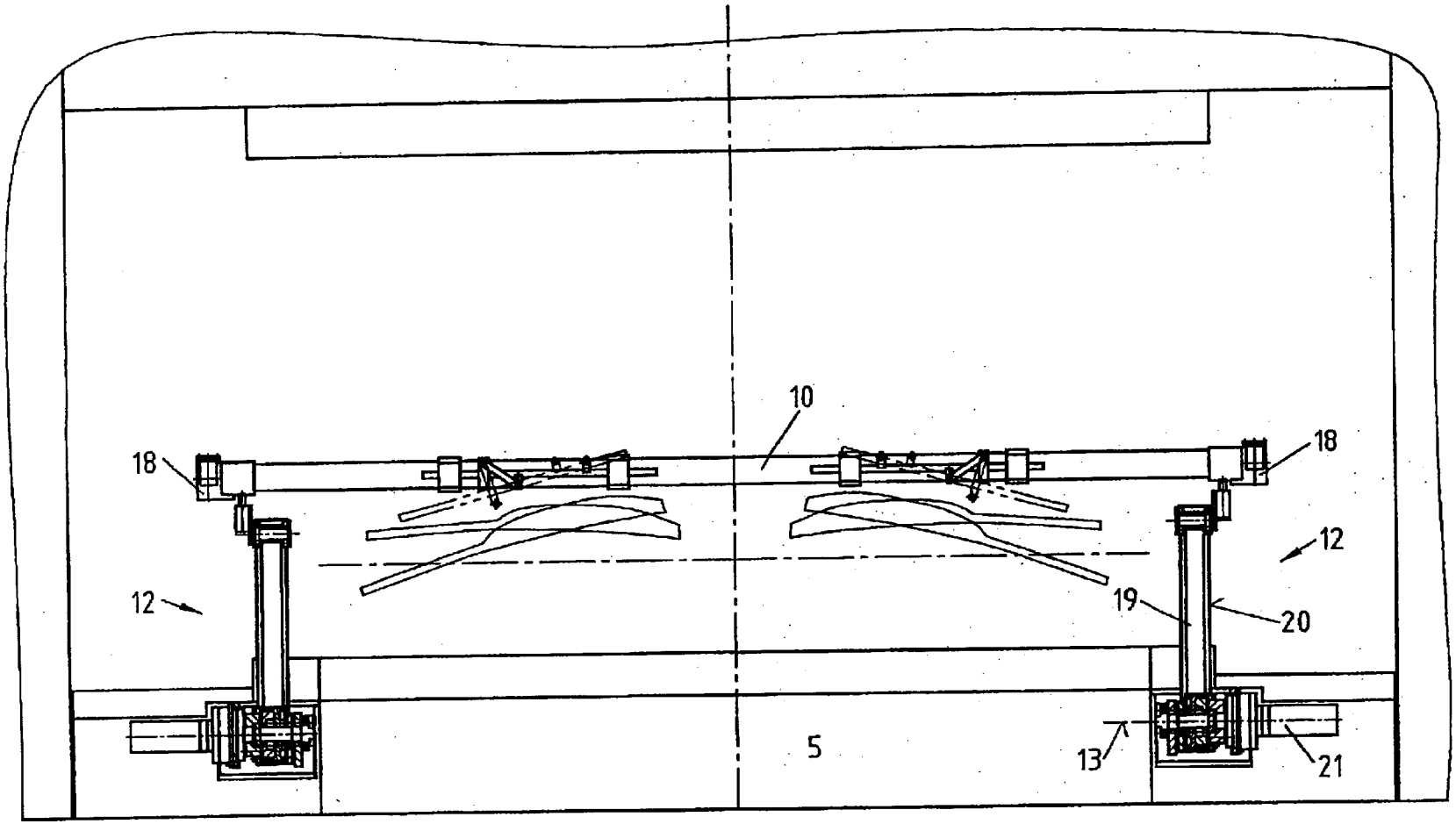
Figure 5:
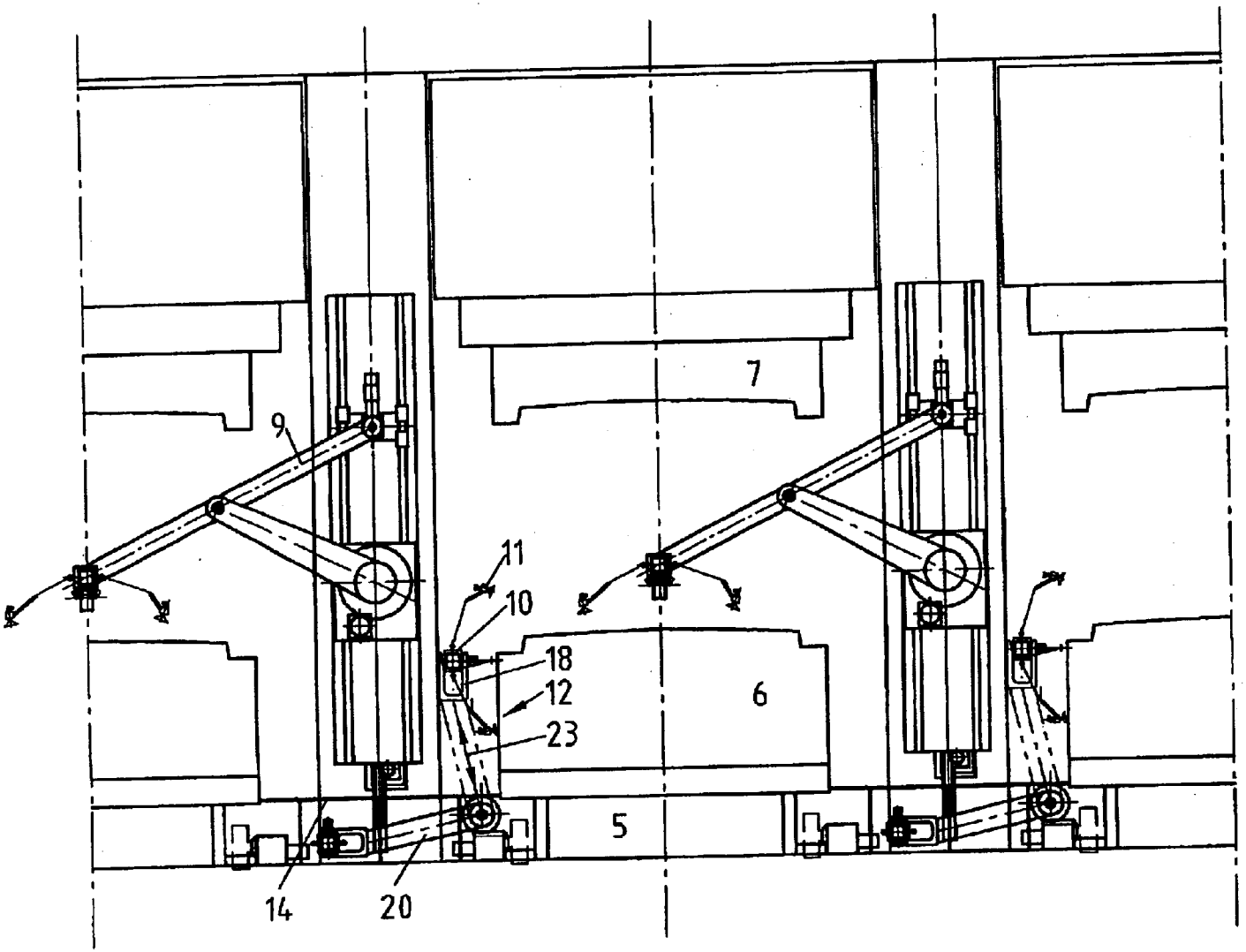
Figure 6:
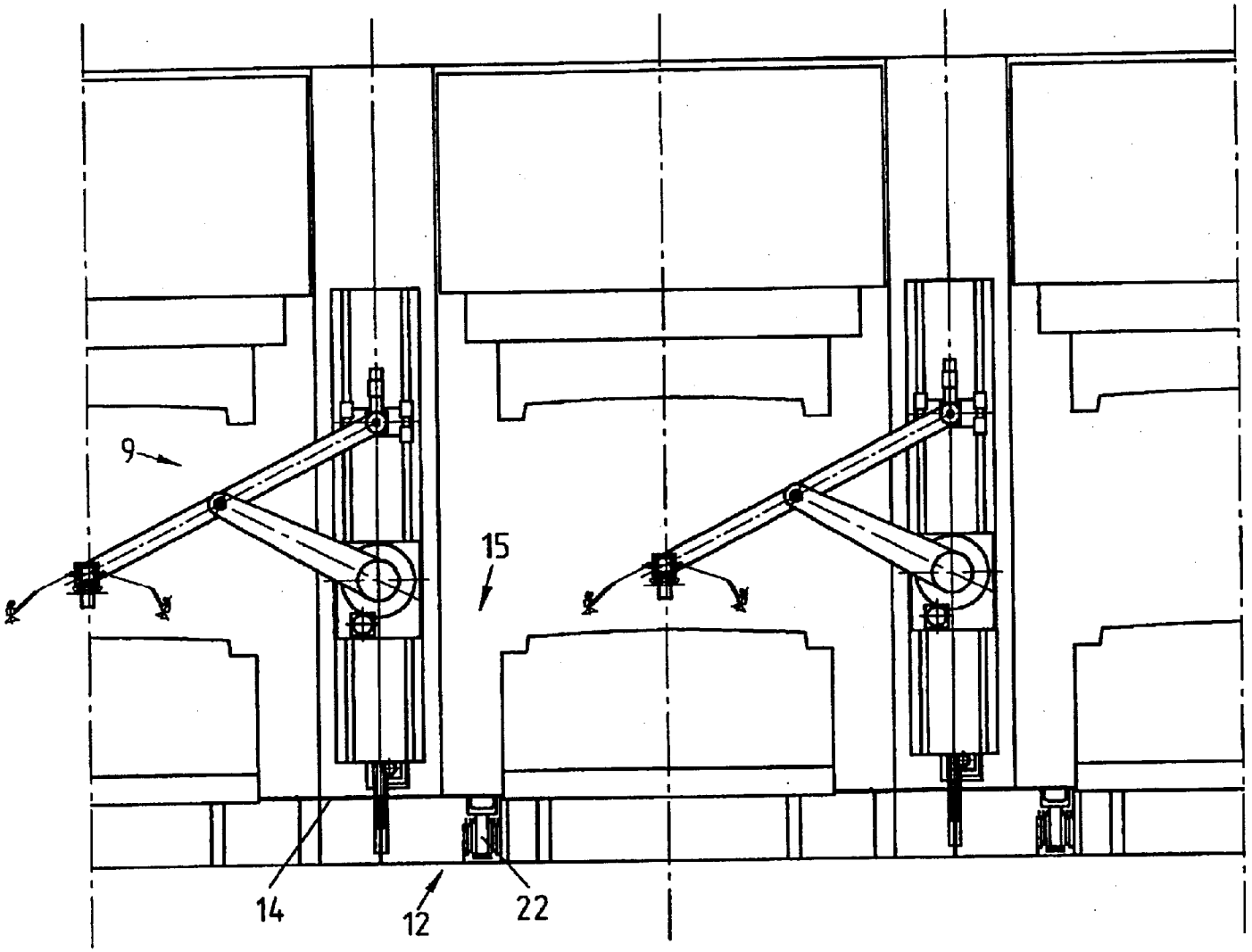
Figure 7:
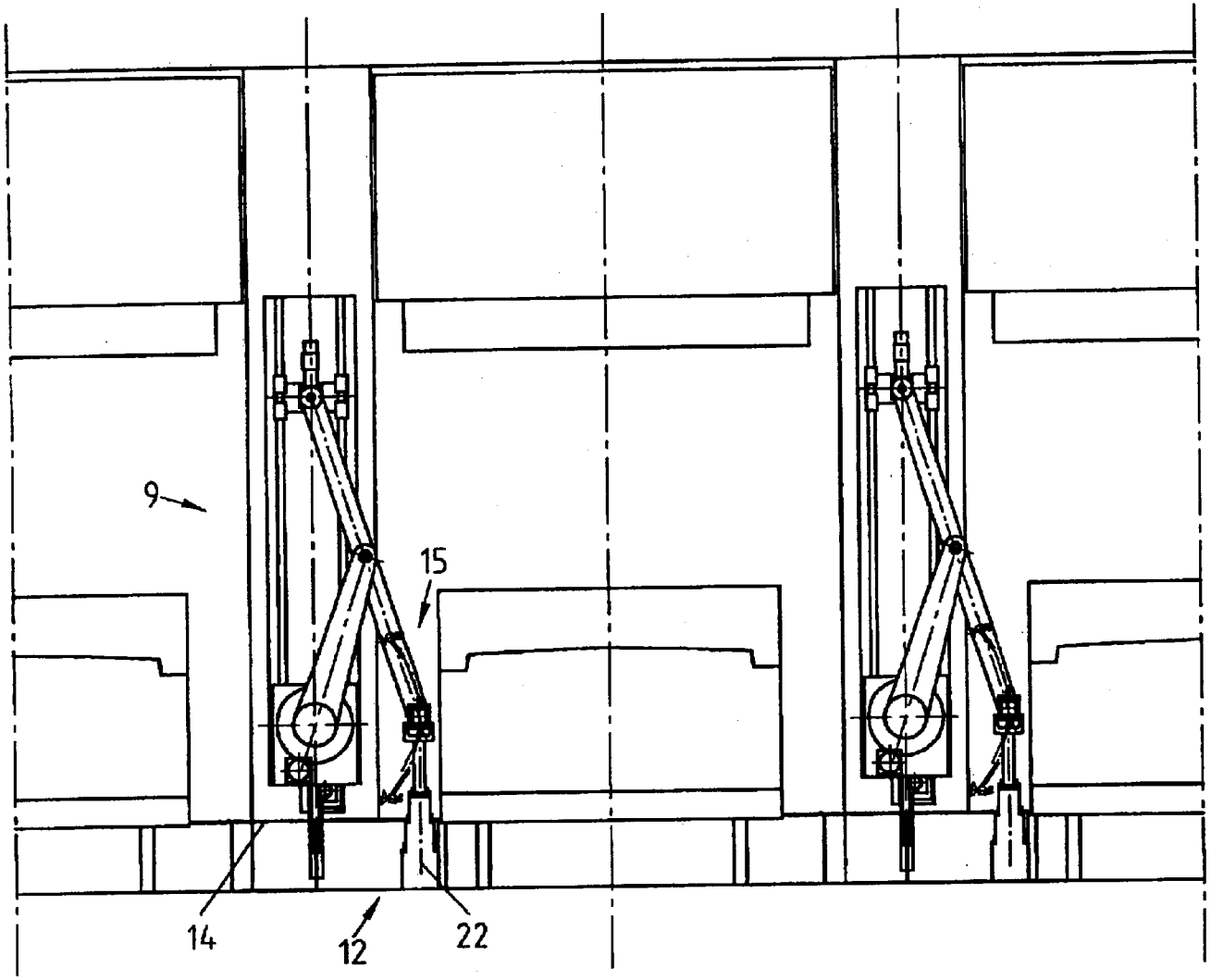

Further advantages and details of the invention are described in greater details in the following description of three examples and evident from the drawings in which FIG. 1 shows a partial view of a multiple-die press for large parts during the production, FIG. 2 is like FIG. 1; however, it shows the suction crossarm in the exchanging position FIG. 3 is like FIG. 1; however it shows the sliding table in the moving out position FIG. 4 shows a partial view at right angles to the transporting direction of the parts FIG. 5 shows an alternative example with a swiveling drive FIG. 6 shows an alternative example with a linear drive doing the production, and FIG. 7 is like FIG. 6, however it shows the suction crossarm in the exchanging position.

A section of a multiple-die press for large parts is shown in FIG. 1. The shaping steps are labeled 2.1 to 2.3, 2.1 and 2.3 being represented only in a half view. Of the press, 1 the rams 3.1 to 3.3 and the pedestals 4.1 and 4.2 can be seen in simplified form. The sliding tables 5.1 to 5.3, which carry the lower tools 6.1 to 6.3, have been moved into the press. The upper tools 7.1 to 7.3 are fastened by means of clamping devices to the rams 3.1 to 3.3. By means of the transporting system 9.1, 9.2, the workpieces, the details of which are not shown, are transported in the transporting direction 8 through the press 1. For this purpose, suction crossarms 10.1, 10.2 are mounted pivotably and fastened to the transporting system 9.1, 9.2. Suction spiders 11.1, 11.2 are provided for accommodating and holding the workpieces. The exchanging devices 12.1, 12.2 for the suction crossarms 10.1, 10.2, can be mounted rotatably at the sliding tables 5.2, 5.3 so that it can be rotated about the axis 13.1, 13.2. FIG. 1 corresponds to the production situation and, for this reason, the exchanging device 12.1, 12.2 is swiveled into a horizontal position. Because of the proposed position of the axis 13.1, 13.2, it is possible to position the exchanging device 12.1, 12.2 below the level of passable covering 14 of the scrap shafts. Accordingly, the interim space 15 is freely accessible.

FIG. 2 shows the transfer of the suction crossarm 10 from the transporting system 9 to the exchanging device 12. The pivoted arm of the transporting system 9 is in a vertical position and the mounting of the exchanging device 12 is swiveled onto the same vertical axis 16. The transporting system 9 can be moved vertically by means of a driving mechanism 17. By these means, the suction crossarm 10 can be transferred to an exchanging device 12 mounting constructed as a fork head 18. A clamping device, for holding the suction crossarm 10 securely, is also fastened to the fork head 18. The suction spider 11 is in a horizontal position.

FIG. 3 shows the vertical position of the suction spider 11. The necessary rotational movement of the suction crossarm 10 is brought about by the exchanging device 12. In this connection, the fork head 18 is swiveled by an unrolling belt drive 19 during the swiveling motion of the exchanging device 12. Since the suction crossarm 10 is held in this fork head 18, it is swiveled by about 90°. If the belt drive 19 is constructed in an appropriate gear ratio, no further driving means are required for the swiveling, since the latter takes place exclusively through the movement of the exchanging device 12.

The sliding table 5 can be moved out of the press 1 without interfering edges. The exchanging device 12 can be swiveled outside of the press 1 for changing the suction crossarm 10 into an ergonomically advantageous position. The handling of the exchanging process by the operating personnel is simplified significantly.

Further structural details are shown in FIG. 4. The exchanging device 12 is constructed in duplicate and, in each case, fastened and mounted in the end region of the sliding table 5. The fork heads 18 for accommodating the suction crossarm 10 are connected at one end with the pivoted arm 20. With its other end, the pivoted arm 20 is mounted so that it can be rotated about the axis 13. The swiveling movement is brought about by the driving mechanism 21. The belt drive 19, which carries out the swiveling motion of the fork head 18, is integrated in the pivoted arm 20.

An alternative embodiment is shown in FIG. 5. The swiveling of the fork head 18 is omitted, as is the belt drive 19 of the exchanging device 12. The transporting system 9 rotates the suction crossarm 10 into a vertical position of the suction spiders 11. For this purpose, the transporting system 9 is swiveled into the exchanging position and, at the same time, rotates the suction crossarm 10 in such a manner, that the suction spider is disposed vertically. The suction crossarm 10 is placed in the fork head 18 by a vertical downward movement of the transporting system 9. After the suction crossarm 10 has been uncoupled fully automatically from the transporting device, the latter can be swiveled into a position, which enables the sliding table to move out of the press undisturbed. Optionally, for the proposed solution, the clamp in the fork head 18 for the suction crossarm 10 can be omitted. By these means, a further simplification of the exchanging device 12 is achieved.

The position of the exchanging device 12, shown by dots and dashes, corresponds to the situation during the changing of the suction crossarm 10 or generally during the exchange of the tool and accessories.

As explained for the first example, the exchanging device, during production, is in the parked position below the passable covering. This is shown by a solid line in FIG. 5.

Without limitation for both examples, the parked position shown can also, rotated by 180°, be directly on the front sides of the sliding table.

For increasing the flexibility, the exchanging device 12 can be equipped with a further axis of movement. The pivoted arm 20, moveable as a telescopic arm, would be constructed as indicated by arrow 23 in FIG. 5. The movement can be brought about by means of a spindle drive or a cylinder. If the sliding table is wide, and therefore the moving-out of the suction spider a problem because of the restricted space, the latter can also be deposited on the tool 6, 7. For this purpose, the pivoted arm 20 would be extended telescopically to a position above the upper tool 7, which is deposed on the lower tool 6. The pivotable mounting 18 of FIGS. 1 to 3 can then be swiveled in with the suction spider 11 over the tools 6, 7. The pivoted arm 20 may optionally be swiveled further in the direction of the tool in order to optimize the moving out situation additionally.

An example of a construction with a liner drive is shown in FIGS. 6 and 7. During the production, the exchanging device 12 is below the covering 14 in the lower position and the interim space 15 is freely passable.

FIG. 7 shows the exchanging position. It can be seen clearly that, due to the moved-in low position of the transporting system 9, the moving out path of the exchanging device 12 may be small. This lifting path is traveled by means of a telescopic cylinder 22. Other telescopic systems, such as a scissors table, can also be used as driving mechanism for the vertical movement.

The invention is not limited to the embodiments described and shown. It also comprises all expert developments within the scope of the valid claims.

Accordingly, the mounting of the suction crossarm is not limited to a fork head, but can also be constructed in other forms, such as a mounting bolt.

1 Multiple-die for large parts
2.1–2.3 Molding stage
3.1–3.3 Rain
4.1, 4.2 Pedestal
5.1–5.3 Sliding table
6.1–6.3 Lower mold
7.1–7.3 Upper mold
8 Transporting direction
9.1, 9.2 Transporting system
10.1, 10.2 Suction crossarm
11.1, 11.2 Suction spider
12.1, 12.2 Exchanging device
13.1, 13.2 Axis of rotation
14 Covering
15 Interim space
16 Vertical
17 Driving mechanism
18 Mounting, fork head
19 Belt drive
20 Swiveling arm
21 Driving mechanism
22 Telescopic cylinder
23 Arrow

What is claimed is:

1. Apparatus for exchanging parts-specific accessories in a multiple stage press, press line, or multiple-die press for large parts, comprising an independent transporting system for each pressing stage which can be uncoupled, a sliding table for carrying a tool, an exchanging device mounted pivotably about an axis of rotation, said axis being beneath an upper edge of the sliding table and transversely to a transporting direction of the parts in an end region of the sliding table.

2. The apparatus of claim 1, further comprising a mounting for the suction crossarm at one end region of the exchanging device and a rotary driving mechanism at a region of another end of the exchanging device.

3. The apparatus of claim 2, wherein the rotary driving mechanism can swivel the exchanging device about the axis of rotation at angles ranging up to 90°, an end position of the swivelling being an approximately horizontal or vertical position.

4. The apparatus of claim 3, further comprising a covering and wherein the end position is approximately horizontal and in that position the exchanging device is disposed below the covering.

5. The apparatus of claim 1, wherein the exchanging device in a vertical or slanted position takes up the suction crossarm.

6. The apparatus of claim 1, wherein the exchanging device comprises a pivoted telescopic arm.

7. Apparatus for exchanging parts-specific accessories in a press, press line, or multiple-die press for large parts, comprising an independent transporting system for each pressing stage a suction crossarm which can be uncoupled, a sliding table for carrying a tool, an exchanging device mounted pivotably about an axis of rotation, said axis being disposed below an upper edge of the sliding table and transversely to a transporting direction of the parts in an end region of the sliding table and a telescoping driving mechanism for driving the exchanging device.

8. The apparatus of claim 1 or 7 further comprising suction spiders carried by the suction crossarm, the suction spiders being rotated by the exchanging device or the transporting system in such a manner that the suction spiders are in an approximately vertical position.

9. The apparatus of claim 7, wherein the exchanging device operates in a position inboard and beneath a covering.

10. The apparatus of claim 1 or 7, wherein the exchanging device is disposed at one end region of the sliding table and a second exchanging device is disposed at a region of another end of the sliding table.

11. The device of claim 7, further comprising a mounting for the suction crossarm at one end region of the exchanging device and the telescopic cylinder at a region of another end of the exchanging device.

12. The apparatus of claim 1, 2 or 11, further comprising a mounting for the suction crossarm and a belt drive for swiveling the mounting integrated in the exchanging device.

* * * * *

UNITED STATES PATENT AND TRADEMARK OFFICE

CERTIFICATE OF CORRECTION

PATENT NO. : 6,786,857 B2
DATED : September 7, 2004
INVENTOR(S) : Erich Harsch et al.

It is certified that error appears in the above-identified patent and that said Letters Patent is hereby corrected as shown below:

Column 6,
Line 2, "stage which" should be changed to -- stage, a suction crossarm which --.

Signed and Sealed this

Fifteenth Day of February, 2005

JON W. DUDAS
*Director of the United States Patent and Trademark Office*